United States Patent [19]

Osborne et al.

[11] Patent Number: 4,793,302

[45] Date of Patent: Dec. 27, 1988

[54] ENGINE COOLING SYSTEM

[75] Inventors: Kenneth Osborne, Peterborough; Howard J. Paul, Stamford, both of England

[73] Assignee: Perkins Engines Group Limited, London, England

[21] Appl. No.: 40,511

[22] Filed: Apr. 20, 1987

[30] Foreign Application Priority Data

Apr. 19, 1986 [GB] United Kingdom ..... 8609626

[51] Int. Cl.[4] ..... F01M 1/00

[52] U.S. Cl. ..... 123/196 AB; 123/41.33; 184/104.1

[58] Field of Search ..... 123/196 AB, 196 R, 41.33; 184/104.1

[56] References Cited

U.S. PATENT DOCUMENTS

| | | | |
|---|---|---|---|
| 3,353,590 | 11/1967 | Holman | 123/41.33 |
| 4,370,957 | 2/1983 | Skatsche et al. | 123/196 AB |
| 4,387,764 | 6/1983 | Lister | 123/196 AB |
| 4,424,778 | 1/1984 | Yoshida | 123/196 AB |
| 4,426,965 | 1/1984 | Patel | 123/196 AB |
| 4,492,632 | 1/1985 | Mattson | 123/196 A |
| 4,520,767 | 6/1985 | Roettgen et al. | 123/41.33 |

*Primary Examiner*—E. Rollins Cross

[57] ABSTRACT

An oil cooler (1) is removably mounted on the side of an engine block (13) with a tubular coolant flow coupling (19) received as a push-fit in an aperture (18) in the block so that the coolant flow connection is simply made as the oil cooler is fastened to the side of the block. The coupling (19) may be a push-fit in respective axially aligned apertures (18,20) in the block and the cooler. The flow coupling may be an inlet coupling for coolant from the block. The end of the coupling that cooperates with the block has an extension (24) that projects into a coolant flow passage (17) in the block and is shaped to form an inlet opening that is directed laterally of the axis of the coupling and upstream of the coolant flow in said passage. The extension (24) collects coolant from said passage and produces a pressure drop in said passage. A coolant return-flow coupling (28) is provided between the oil cooler (1) and the block (13) and opens into said passage (17) downstream of said inlet coupling (19) so that said pressure drop assists the flow of coolant through the cooler.

13 Claims, 3 Drawing Sheets

ENGINE COOLING SYSTEM

TECHNICAL FIELD

This invention relates to engine cooling systems of the type in which liquid coolant is circulated through passages in the block of the engine so as to cool the latter. Generally, the coolant is also circulated through a separate cooler for the lubricating oil of the engine, the cooler either being connected into the coolant flow path by hoses or being mounted on the side of the engine so as to cooperate with a coolant flow passage in the block.

DISCLOSURE OF THE INVENTION

An object of the present invention is to provide an engine with an oil cooler having simple connections for the coolant flow between the engine block and oil cooler.

According to the invention, an oil cooler is removably mounted on the side of an engine block with a tubular coupling forming a coolant flow connection therebetween, the coupling being received as a push-fit in an aperture in the block so said flow connection is simply made as the oil cooler is fastened to the side of the block. Preferably, the coupling is received in respective axially aligned apertures in the block and the cooler, and is permanently fixed in the aperture in the cooler.

Preferably the flow coupling is an inlet coupling for coolant from the block, and the end of the coupling that cooperates with the block has an extension that projects into a coolant flow passage in the block and is shaped to form an inlet opening that is directed laterally of the axis of the coupling and upstream of the coolant flow in said passage, so as to act as a scoop which collects coolant from said passage. Preferably, the extension and said passage are dimensioned so that the extension produces a pressure drop in said passage across the flow path past the inlet coupling, and a coolant return-flow coupling is provided between the oil cooler and the block opening into said passage downstream of said inlet coupling so that the pressure drop assists the flow of coolant through the cooler.

DESCRIPTION OF THE DRAWINGS

The invention will now be described by way of example with reference to the accompanying drawings in which.

BEST MODE OF CARRYING OUT THE INVENTION

Figure 1:
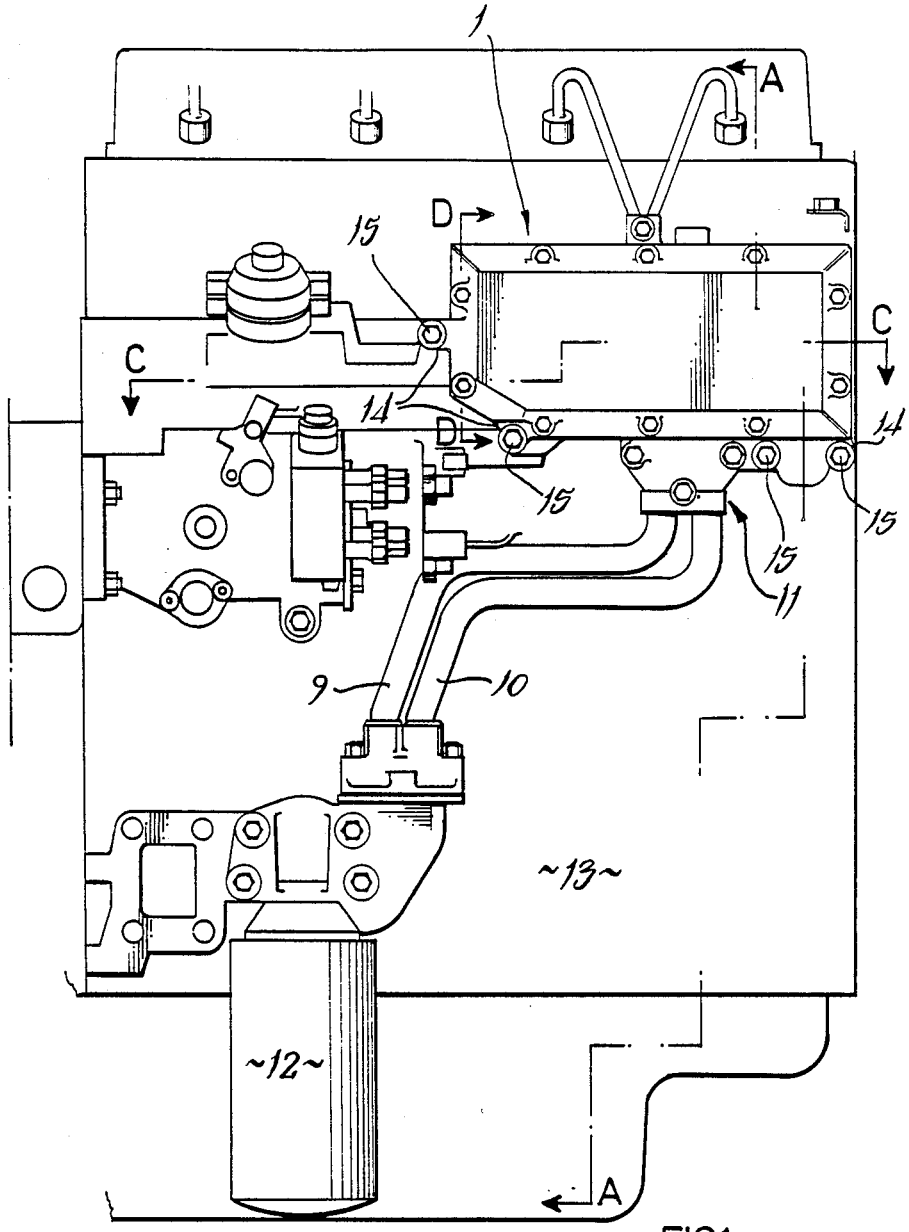
FIG. 1 is a side elevation of an engine fitted with an oil cooler according to the invention.

The illustrated oil cooler 1 comprises a cooler back-plate 2 that is formed with oil inlet and oulet passages 3, 4, an oil cooler stack 5 that is connected to the back-plate so that the oil flow-path 6 therethrough communicates with the oil inlet and outlet passages 3, 4, and a cooler cover 7 that is connected to the back-plate 2 so as to form a coolant chamber 8 containing the cooler stack 5. A pair of hoses 9, 10 are connected to the oil passages

3, 4 of the back-plate via a coupling 11 and are connected to an oil filter 12 mounted on the side of the engine block 13. An oil pump (not shown)is driven by the engine and circulates oil through the filter 12 and oil cooler 1.

Figure 3:
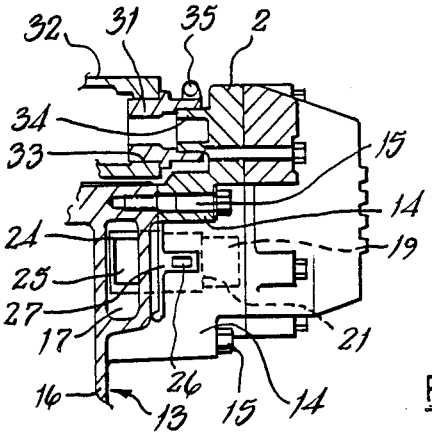
FIG. 3 is a vertical section along the line D—D in FIG. 1.

The cooler is fastened to the side wall 16 of the block by bolts 15 at four points 14. Coolant for the cooler is taken from a gallery 17 that runs along the side of the block. An aperture 18 opens from the gallery 17 through the side wall 16 of the block and supplies coolant to the cooler through a tubular coupling 19 to an inlet aperture 20 in the backplate 2 that opens into the chamber 8. The two apertures 18 and 20 are circular in cross-section. The coupling 19 is permanently fixed in the aperture 20 by adhesive and is axially aligned with the aperture 18 to be received therein as a push-fit as the cooler is fastened to the side of the block. An external shoulder 21 on the coupling abuts the rear face of the back-plate, and an external annular recess 22 at the inner end of the coupling carries an O-ring seal 23 that engages within the aperture 18. To ensure that the coupling 19 is correctly orientated about its central axis when assembled in the aperture 20, an external projection 26 is provided on the side wall os the coupling that engages in a slot 27 formed in the back-plate 2, as shown in FIGS. 3 and 4.

Figure 4:
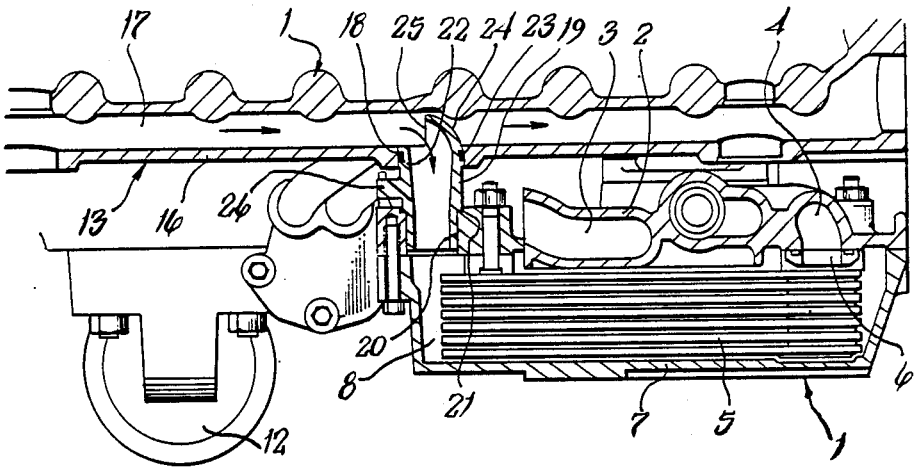
FIG. 4 is a horizontal section along the line C—C in FIG. 1.

An extension 24 projects from the inner end of the coupling into the gallery 17 and is shaped so as to form a scoop with an inlet opening 25 that is directed laterally of the axis of the coupling and downstream of the coolant flow along the gallery 17, as shown by arrows in FIG. 4. The extension 24 is shaped so that the inlet opening 25 is rectangular (as seen in FIG. 3) and has sufficient area compared with the cross-sectional area of gallery 17 to produce a pressure drop in the gallery downstream of the coupling 19.

Figure 2:
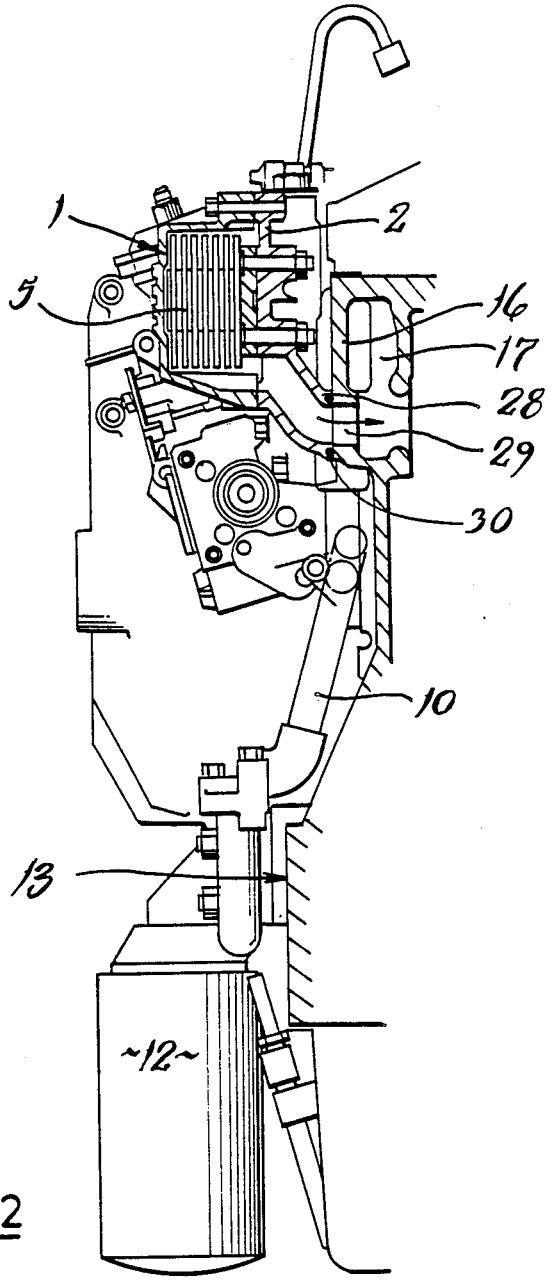
FIG. 2 is a vertical section along the line A—A in FIG. 1.

Coolant exits from the chamber 8 of the cooler through a duct 28 formed in the back-plate that cooperates with an outlet aperture 29 in the side wall 16 of the block (FIG. 2). Aperture 29 opens into the gallery 17 downstream of the coupling 19, and the lower pressure at this point serves to induce coolant flow through the chamber 8. An O-ring seal 30 received in a recess in the end of the duct 28, abuts the side wall 16 around the aperture 29 to form a seal.

A further connection is provided between the engine and the cooler in the form of a plug-in connection 31 that vents air from the cooler to the head 32 of the engine. The connector 31 is composed of rubber and is a push-fit in an aperture 33 in the head and is a push-fit over a collar 34 that projects from the rear of the back-plate. A hose clip 35 surrounds the outer end of the connector 31 and fastens it onto the collar 34.

We claim:

1. A method of mounting an oil cooler on the side of an engine block comprising the steps of:

(i) providing the cooler with a back-plate and a tubular rigid coolant flow coupling that projects rearwardly from the back-plate and terminates in an inlet opening that is directed laterally of the axis of the coupling;

(ii) locating the back-plate on the side of the engine block with the coupling inserted as a push-fit in an aperture in the block with the inlet opening directed upstream of a flow of coolant in the block; and (iii) fastening the cooler to the side of the engine block with fasteners that engage the back-plate and block.

2. A method as claimed in claim 1 in which the coupling is a separate component that is fitted into an aperture in the back-plate of the cooler.

3. A method as claimed in claim 1 in which an annular seal is provided between the coupling and the aperture in the block into which it is inserted.

4. A method as claimed in claim 1 in which formations are provided on the coupling and back-plate that cooperate to orientate the coupling angularly about its axis so that the inlet opening is directed upstream of the flow of coolant in the block.

5. A method as claimed in claim 1 in which the coupling projects into a coolant flow passage in the block so as to produce a drop in pressure in the flow passage downstream of the coupling, a further coolant flow connection being provided between the cooler and the flow passage downstream of the coupling so as to return a flow of coolant from the cooler to the block.

6. A method as claimed in claim 5 in which said further connection comprises mating surfaces that extend laterally of the axis of the coupling so that they are brought into face-to-face sealing contact when the coupling is inserted into the aperture in the block.

7. A method as claimed in claim 1 in which a tubular rigid connector is provided as a push-fit with the block and the cooler to provide an air vent connection from the cooler to the block at a high point in the cooler, the axis of the connector being parallel to the axis of the coupling so that both the connector and the coupling can be inserted together.

8. An engine comprising an engine block with a coolant flow passage therein, and an oil cooler having a back-plate and a tubular rigid coolant flow coupling that projects rearwardly from the back-plate and terminates in an inlet opening that is directed laterally of the axis of the coupling, the cooler being mounted on the engine block with the coupling inserted as a push-fit in an aperture in the block that opens into the coolant flow passage so that the inlet opening is directed upstream of the flow of coolant in the passage.

9. An engine as claimed in claim 8 in which the coupling and respective apertures in the block and cooler are axially aligned.

10. An engine as claimed in claim 8 in which the coupling is permanently fixed in the aperture in the cooler.

11. An engine as claimed in claim 8 in which the coupling is an inlet flow coupling for coolant from the block to the cooler.

12. An engine as claimed in claim 8 which includes a further coolant flow connection between the cooler and the flow passage downstream of the coupling so as to return a flow of coolant from the cooler to the block.

13. An engine as claimed in claim 12 in which a tubular connector is provided as a push-fit with the engine and the cooler to provide an air vent connection from the cooler to the engine at a high point in the cooler.

* * * * *